US008398207B2

(12) United States Patent
Nagata et al.

(10) Patent No.: US 8,398,207 B2
(45) Date of Patent: Mar. 19, 2013

(54) INKJET RECORDING HEAD AND INKJET RECORDING METHOD

(75) Inventors: Shingo Nagata, Kawasaki (JP); Hiromasa Amma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 492 days.

(21) Appl. No.: 12/581,803

(22) Filed: Oct. 19, 2009

(65) Prior Publication Data

US 2010/0097425 A1 Apr. 22, 2010

(30) Foreign Application Priority Data

Oct. 21, 2008 (JP) ..... 2008-271040

(51) Int. Cl.
*B41J 2/14* (2006.01)
*B41J 2/05* (2006.01)

(52) U.S. Cl. ..... 347/47; 347/61

(58) Field of Classification Search ..... 347/47, 347/54, 56

See application file for complete search history.

(56) References Cited

U.S. PATENT DOCUMENTS 6,652,079 B2 * 11/2003 Tsuchii et al. ..... 347/65
8,087,759 B2 * 1/2012 Oikawa et al. ..... 347/65

FOREIGN PATENT DOCUMENTS

JP 2002-248769 A 9/2002

* cited by examiner

*Primary Examiner* — Matthew Luu
*Assistant Examiner* — Lisa M Solomon
(74) *Attorney, Agent, or Firm* — Canon U.S.A, Inc. IP Division

(57) ABSTRACT

An apparatus includes nozzles and an ink passage. Each nozzle includes a pressure chamber which houses an electrothermal transducer provided on a substrate to apply ejection energy to ink, an ink ejection orifice which faces the electrothermal transducer, and an ink passage along which the ink is supplied to the pressure chamber. The ink supply port is provided on the substrate and communicates with the ink passages. A distance between a center of gravity of the electrothermal transducer and the ink supply port differs between the nozzles which are next to each other. In at least one of the nozzles, a center of gravity of the ink ejection orifice is shifted from that of the electrothermal transducer in a direction toward the ink supply port by an amount which is increased as the distance increases.

9 Claims, 10 Drawing Sheets

H1000

| DISTANCE L (μm) | OFFSET BETWEEN ELECTROTHERMAL TRANSDUCER AND EJECTION ORIFICE (μm) | | | |
|---|---|---|---|---|
| | −4 | 0 | 4 | 8 |
| 86.5 | POOR | GOOD | GOOD | FAIR |
| 106.5 | POOR | POOR | GOOD | FAIR |

INKJET RECORDING HEAD AND INKJET RECORDING METHOD

BACKGROUND OF THE INVENTION

1. Field of the Invention

The present invention relates to a recording head, and more particularly a recording head which performs a recording operation by ejecting ink toward a recording medium.

2. Description of the Related Art

FIGS. 5A and 5B are schematic diagrams illustrating a portion of a nozzle section in an inkjet recording head according to a related art. FIG. 5A is a plan view, seen through an orifice plate, of the portion of the nozzle section, and FIG. 5B is a sectional view of FIG. 5A taken along line VB-VB.

The inkjet recording head shown in FIGS. 5A and 5B includes an ink supply port 305 through which the ink is supplied to ink passages 303 and a common liquid chamber 304 which communicates with the ink supply port 305. Electrothermal transducers 300 which generate bubbles of ink to eject the ink and pressure chambers 302 in which the electrothermal transducers 300 are disposed are arranged on either side of the common liquid chamber 304. The pressure chambers 302 and the electrothermal transducers 300 are positioned such that the center of gravity of each pressure chamber 302 coincides with the center of gravity of the corresponding electrothermal transducer 300. The ink passages 303 are disposed between the common liquid chamber 304 and the pressure chambers 302, and ink ejection orifices 301 are provided at positions where the ink ejection orifices 301 face the corresponding electrothermal transducers 300.

In this inkjet recording head, the positions of the ink ejection orifices 301 and the electrothermal transducers 300 which are next to each other are shifted from each other in a printing direction (direction in which the carriage is moved) by an amount corresponding to a distance by which the carriage moves within a time interval between times at which respective driving blocks are driven. Since the electrothermal transducers 300 which are next to each other are not driven simultaneously, a so-called crosstalk can be reduced.

For simplicity of explanation, FIG. 5A shows the inkjet recording head in which the nozzles are assigned to four driving blocks and the positions at which the ink ejection orifices 301 are arranged in the printing direction cyclically vary with a period of four nozzles. If the driving blocks are numbered in ascending order from the driving block which is driven first, the upper right ink ejection orifice 301 is assigned to driving block 1 in the example shown in FIG. 5A. The ink ejection orifice 301 on the left side of the upper right ink ejection orifice 301 is assigned to driving block 2, the next ink ejection orifice 301 is assigned to driving block 3, and the next ink ejection orifice 301 is assigned to driving block 4. In the above-described structure, the driving blocks 1 to 4 are successively driven in the ascending order to cause the respective ink ejection orifices 301 to eject ink droplets. Accordingly, the thus-ejected ink droplets land on the recording medium on a straight line.

The above-described structure in which the positions of the ink ejection orifices and the electrothermal transducers are shifted from each other in the printing direction (direction in which the carriage is moved) is described in, for example, Japanese Patent Laid-Open No. 6-238904.

In the above-described inkjet recording head, it is important to eject the ink in a direction substantially perpendicular to the electrothermal transducers and to maintain the manner in which the ink is ejected. If the manner in which the ink is ejected in a direction substantially parallel to the electrothermal transducers cannot be maintained, small droplets (satellite droplets), which are generated together with the main droplets, collide with wall surfaces of the ink ejection orifices and are collected in areas near the ink ejection orifices. Then, when the volume of the ink collected on the surfaces of the ink ejection orifices reaches a certain volume, the collected ink interferes with the ink ejected from the ink ejection orifices and affects the ink ejection state.

To avoid this, Japanese Patent Laid-Open No. 2002-248769 discusses a structure in which the centers of gravity of the ink ejection orifices are offset from the centers of gravity of the electrothermal transducers. FIGS. 6A and 6B show a portion of a nozzle section in which the centers of gravity of the ink ejection orifices are offset from the centers of gravity of the electrothermal transducers. FIG. 6A is a plan view, seen through an orifice plate, of the portion of the nozzle section, and FIG. 6B is a sectional view of FIG. 6A taken along line VIB-VIB. In FIGS. 6A, and 6B, the center lines of ink passages 403 are at positions offset from the center lines of the electrothermal transducers 400. In addition, the centers of gravity of ink ejection orifices 401 are offset from the centers of gravity of the electrothermal transducers 400 in a direction away from an ink supply port 405. According to Japanese Patent Laid-Open No. 2002-248769, the collection of ink in the areas near the ink ejection orifices can be prevented by the above-described structure.

The inventors of the present invention have conducted experiments with different amounts of offsets between the centers of gravity of the ink ejection orifices and the centers of gravity of the electrothermal transducers in the structure in which the distances between the common liquid chamber and the electrothermal transducers in the nozzles which are next to each other differ from each other. As a result, the inventors have newly found that the occurrence status of print defects caused by the above-described collection of ink varies in accordance with the distance between the ink supply port and the electrothermal transducers. The experiments have been conducted using nozzles A and B which are next to each other and in which the distances between the ink supply port and the electrothermal transducers differ from each other. As a result, no print defects have occurred in either of the nozzles A and B when the offset between the centers of gravity of the ink ejection orifices and the centers of gravity of the electrothermal transducers was set to a certain value. However, when the offset was set to another value, print defects have occurred only in the nozzle B. In addition, when the offset between the centers of gravity of the ink ejection orifices and the centers of gravity of the electrothermal transducers was equal to or more than a certain value, the ink ejection characteristics greatly varied and print defects due to causes other than the collection of ink have occurred.

SUMMARY OF THE INVENTION

According to the present invention, an apparatus includes a plurality of nozzles, each nozzle including a pressure chamber which houses an electrothermal transducer provided on a substrate to apply ejection energy to ink, an ink ejection orifice which faces the electrothermal transducer, and an ink passage along which the ink is supplied to the pressure chamber; and an ink supply port provided on the substrate, the ink supply port communicating with the ink passages. A distance between a center of gravity of the electrothermal transducer and the ink supply port differs between the nozzles which are next to each other. In at least one of the nozzles, a center of gravity of the ink ejection orifice is shifted from the center of gravity of the electrothermal transducer in a direction toward the ink supply port by an amount. The amount increases as the distance increases.

Further features of the present invention will become apparent from the following description of exemplary embodiments with reference to the attached drawings.

DESCRIPTION OF THE EMBODIMENTS

In the following description, an inkjet recording operation will be explained as an example of application of the present invention. However, the present invention is not limited to this, and may also be applied to other kinds of operations, such as an operation of manufacturing biochips or printing electronic circuits.

Liquid ejection heads may be mounted on apparatuses such as a printer, a copy machine, a facsimile machine having a communication system, and a word processor including a printer unit, or on industrial recording apparatuses combined with various kinds of processing devices. The liquid ejection heads may be used in the operation of, for example, manufacturing biochips, printing electronic circuits, or ejecting medicine in the form of mist.

In the case where, for example, the liquid ejecting heads are used in a recording operation, various kinds of recording media, such as paper, yarn, fiber, textile, leather, metal, plastic, glass, wood, and ceramics, may be subjected to the recording operation.

In this specification, the term "recording" means not only an operation of forming images such as characters and symbols which have meanings but also an operation of forming images such as patterns which have no meanings.

Embodiments of the present invention will now be described with reference to the drawings.

Figure 2:
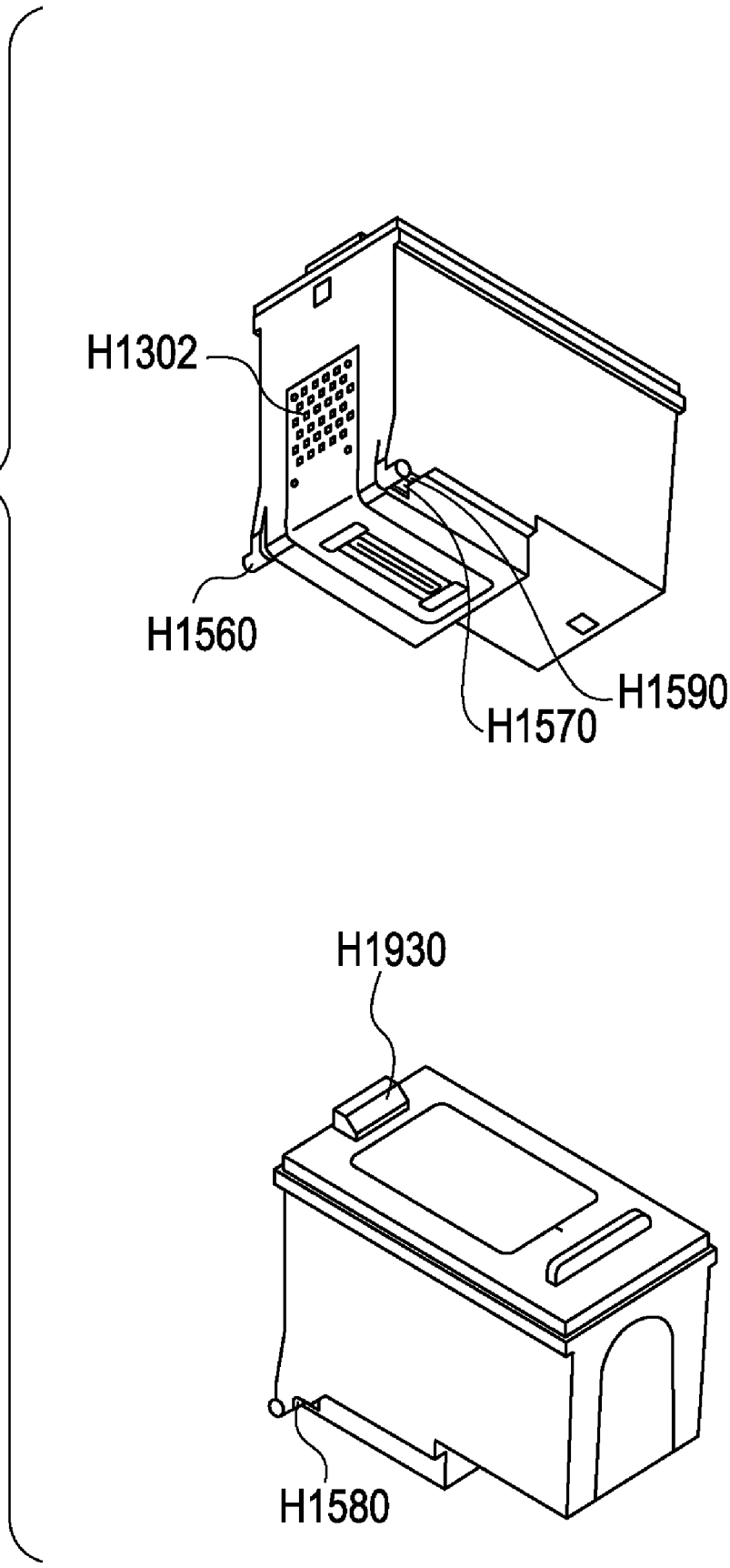
FIG. 2 is a perspective view illustrating the overall structure of an inkjet recording head according to the present invention.
Figure 3:
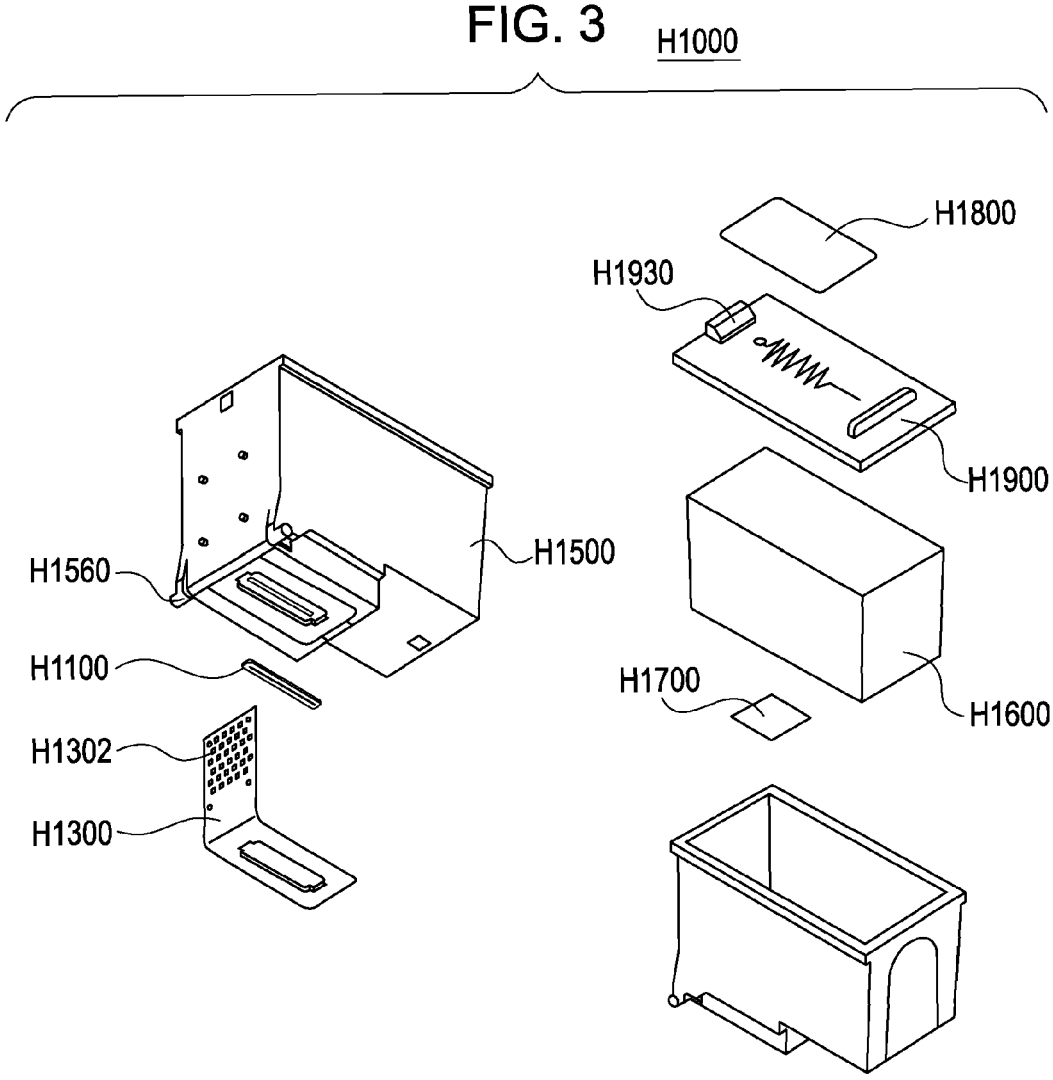
FIG. 3 is an exploded perspective view illustrating the inkjet recording head according to the embodiment of the present invention.
Figure 4:
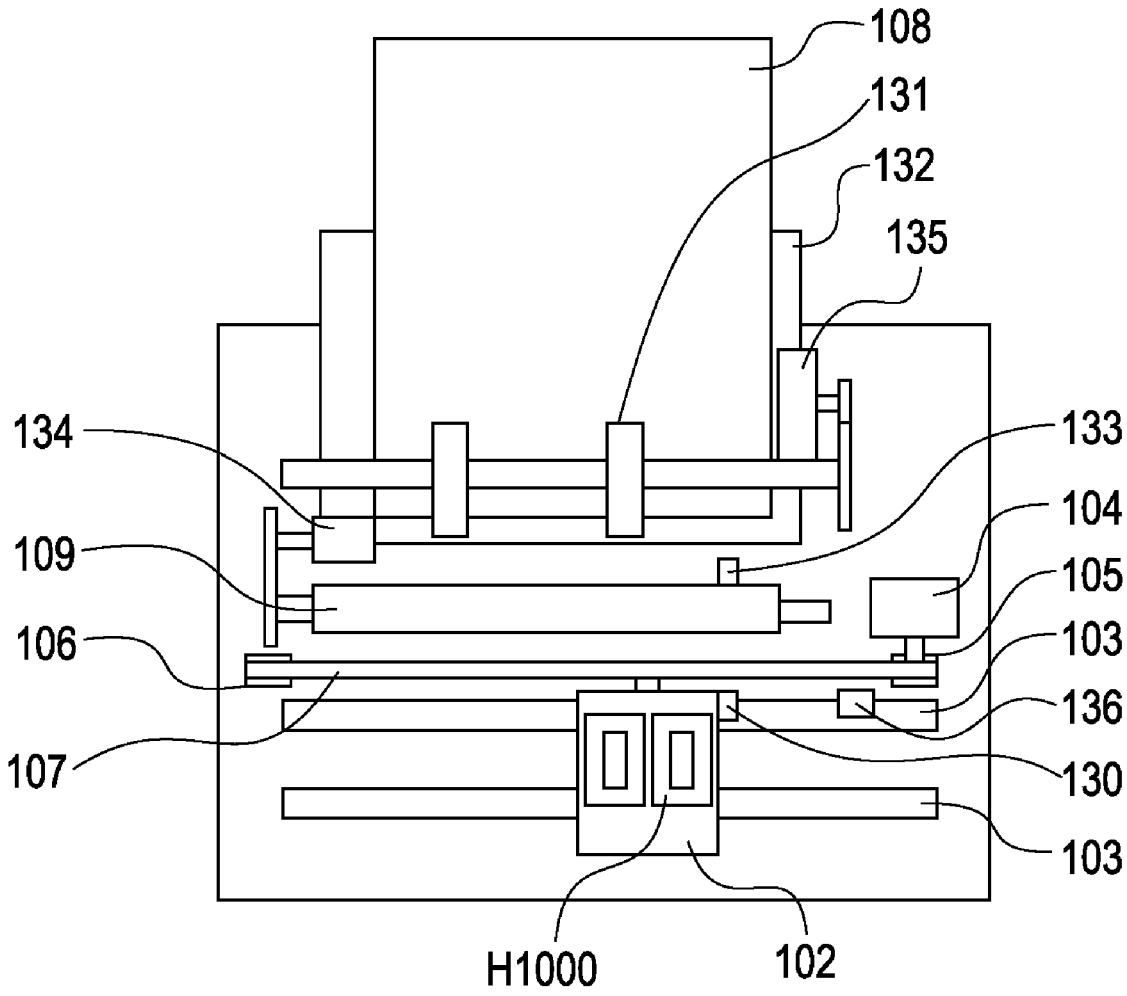
FIG. 4 is a schematic diagram illustrating the overall structure of an inkjet recording apparatus according to the present invention.
Figure 5A:
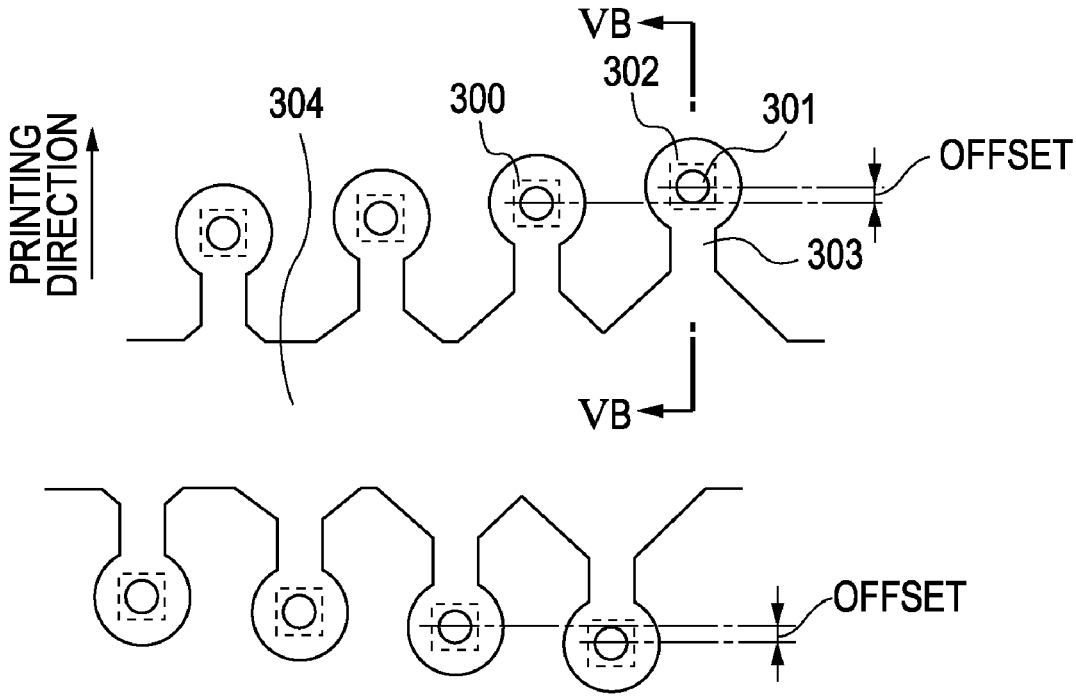
FIGS. 5A and 5B are schematic diagrams illustrating a nozzle section of an inkjet recording head according to a related art.
Figure 5B:
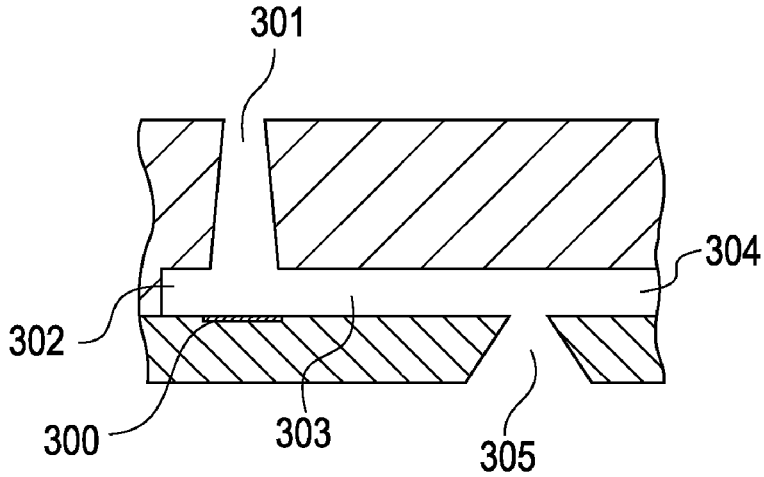
Figure 6A:
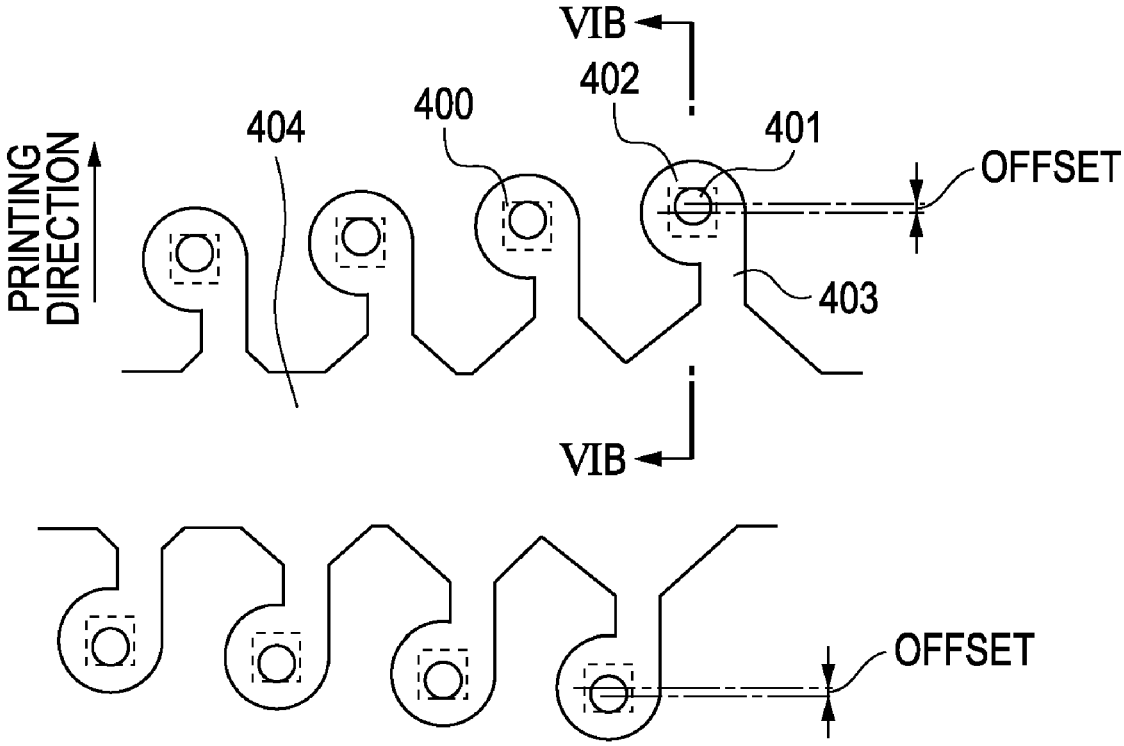
FIGS. 6A and 6B are schematic diagrams illustrating a nozzle section of another inkjet recording head according to a related art.
Figure 6B:
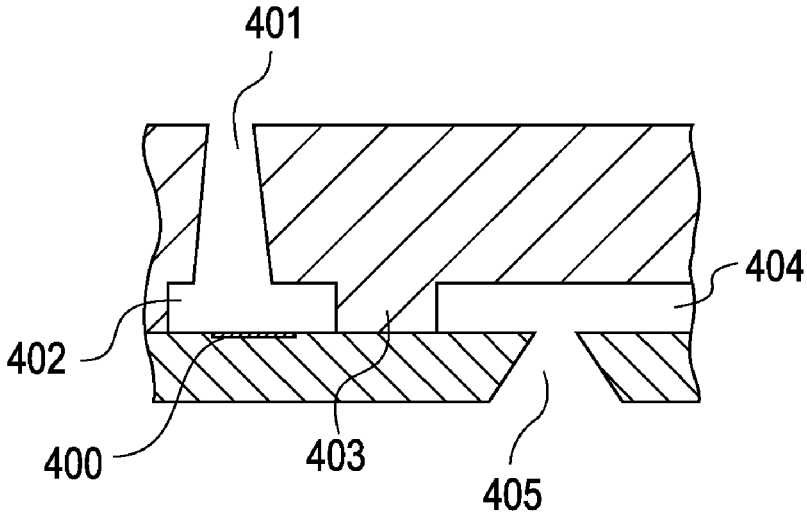

FIGS. 2 to 4 are diagrams illustrating an inkjet recording head to which the present invention can be applied. Components of the inkjet recording head will be described with reference to FIGS. 2 to 4.

1. Inkjet Recording Head

An inkjet recording head H1000 is a recording head including electrothermal transducers which generate ejection energy for causing film boiling of ink in accordance with an electric signal. In addition, the inkjet recording head H1000 is a so-called side-shooter type recording head in which the electrothermal transducers and ejection orifices from which ink droplets are ejected are arranged so as to face each other.

The inkjet recording head H1000 ejects ink (i.e., black ink). As show in FIG. 3, the inkjet recording head H1000 includes a recording element substrate H1100, an electric wiring tape H1300, an ink supply holder H1500, a filter H1700, and an ink absorber H1600. The inkjet recording head H1000 also includes a lid member H1900 and a sealing member H1800. The above-described cartridge type inkjet recording head H1000 is shipped while a protecting tape (not shown) is adhered to a surface of the inkjet recording head H1000 so as to cover the ejection orifices formed in the recording element substrate H1100.

2. Mounting of Inkjet Recording Head on Inkjet Recording Apparatus

As shown in FIG. 2, the inkjet recording head H1000 is provided with attachment guides H1560 used to guide the main body of the inkjet recording head H1000 to an attachment position in a carriage. The inkjet recording head H1000 is also provided with an engaging portion H1930 used to fix the inkjet recording head H1000 to the carriage by using a head set lever and an abutting portion H1570 used to position the inkjet recording head H1000 at a predetermined attachment position in the carriage in an X direction (carriage scanning direction). The inkjet recording head H1000 is also provided with abutting portions H1580 and H1590 used to position the inkjet recording head H1000 in a Y direction (recording-medium conveying direction) and a Z direction (ink ejecting direction), respectively. The inkjet recording head H1000 is positioned by the above-described abutting portions, so that an electrical connection between an external signal input terminal H1302 provided on the electric wiring tape H1300 and an electrical connection portion provided in the carriage can be reliably obtained.

3. Inkjet Recording Apparatus

The inkjet recording apparatus in which the above-described cartridge type inkjet recording head can be mounted will now be described. FIG. 4 shows an example of a recording apparatus in which the inkjet recording head according to the present invention can be mounted.

In the recording apparatus shown in FIG. 4, the inkjet recording head H1000 shown in FIG. 2 is positioned on a carriage 102 in a replaceable manner. The carriage 102 includes the electrical connection portion for transmitting a driving signal to each of ejection portions through the external signal input terminal provided on the inkjet recording head H1000.

The carriage 102 is supported such that the carriage 102 can reciprocate along a guide shaft 103 disposed in the main body of the recording apparatus. The guide shaft 103 extends in a main scanning direction. The carriage 102 is driven by a driving mechanism including a motor pulley 105, a driven pulley 106, and a timing belt 107, and the driving mechanism is driven by a main scanning motor 104. The position and movement of the carriage 102 are controlled. A home position sensor 130 is provided on the carriage 102. Accordingly, the position of the carriage 102 can be detected at the time when the home position sensor 130 on the carriage 102 passes a shielding plate 136.

Recording media 108, such as printing sheets or thin plastic plates, are supplied one at a time from an automatic sheet feeder (ASF) 132. The recording media 108 are supplied by rotating pickup rollers 131 with a gear driven by a sheet feeding motor 135. The thus-supplied recording medium 108 is conveyed by the rotation of a conveying roller 109 (sub-scanning) through a position (print section) at which the recording medium 108 faces an ejection orifice surface of the inkjet recording head H1000. The conveying roller 109 is rotated by a gear which is driven by a rotation of an LF motor 134. At this time, determination of whether or not the recording medium 108 has been supplied and determination of the leading end position of the recording medium 108 are performed when the recording medium 108 passes a paper end sensor 133. The paper end sensor 133 is also used to detect the actual position of the trailing end of the recording medium 108 and to determine the current recording position on the basis of the actual position of the trailing end.

The back surface of the recording medium 108 is supported by a platen (not shown) so that the recording medium 108 forms a flat print surface in the print section. In this case, the inkjet recording head H1000 mounted on the carriage 102 is held such that the ejection orifice surface thereof projects downward from the carriage 102 and is parallel to the recording medium 108 in an area between two pairs of conveying rollers.

The inkjet recording head H1000 is mounted on the carriage 102 such that the direction in which the ejection orifices are arranged crosses the scanning direction of the carriage 102. The inkjet recording head H1000 performs a recording operation by ejecting the ink from the ejection orifices.

In a first embodiment, the offsets between the centers of gravity of the ink ejection orifices and the centers of gravity of the electrothermal transducers are varied, and the occurrence status of print defects caused by the nozzles in which distances between an ink supply hole and electrothermal transducers differ from each other is confirmed.

Figures 7, 8:
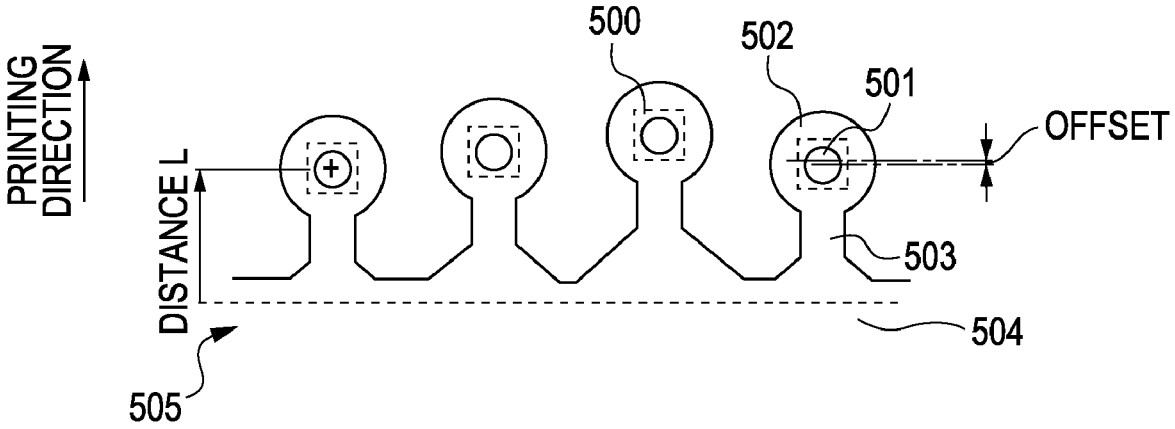
FIG. 7 is a schematic diagram illustrating a nozzle section of an inkjet recording head according to a first embodiment of the present invention.
FIG. 8 is a table illustrating the result of evaluation of a printing operation according to the first embodiment of the present invention.

FIG. 7 is a schematic diagram illustrating a nozzle section of an inkjet recording head according to the present embodiment. According to the present invention, each nozzle includes an ink passage 503, a pressure chamber 502, and an ink ejection orifice 501.

The inkjet recording head shown in FIG. 7 includes a common liquid chamber 504 which communicates with an ink supply port 505. Electrothermal transducers 500 which generate bubbles of ink to eject the ink and pressure chambers 502 in which the electrothermal transducers 500 are disposed are arranged on either side of the common liquid chamber 504. In FIG. 7, only the nozzles on one side of the common liquid chamber 504 are shown for simplicity of explanation. The pressure chambers 502 and the electrothermal transducers 500 are positioned such that the center of gravity of each pressure chamber 502 coincides with the center of gravity of the corresponding electrothermal transducer 500. The ink passages 503 are disposed between the common liquid chamber 504 and the pressure chambers 502, and ink ejection orifices 501 are provided at positions where the ink ejection orifices 501 face the corresponding electrothermal transducers 500. In the present embodiment, the volumes of ink droplets ejected from the respective ink ejection orifices are substantially equal to each other.

In this inkjet recording head, the positions of the ink ejection orifices 501 and the electrothermal transducers 500 which are next to each other are shifted from each other in a printing direction (direction in which the carriage is moved) by an amount of offset corresponding to a distance by which the carriage moves within a time interval between times at which respective driving blocks are driven. In other words, the distance L between the ink supply port and the center of gravity of each electrothermal transducer differs between the nozzles which are next to each other. In the following description, the distance L is defined as the distance between the center of gravity of each electrothermal transducer and an end of the ink supply port. In the present embodiment, a plurality of kinds of distances L are set. More specifically, sixteen kinds of distances L are set. However, only four kinds of distances L are shown in FIG. 7 for simplicity.

As described above, the positions of the ink ejection orifices and the electrothermal transducers in the printing direction are shifted by an amount of offset corresponding to the distance by which the carriage moves within the time interval between the times at which the respective driving blocks are driven. Accordingly, the ink droplets ejected from the ink ejection orifices land on the recording medium on a straight line. Each ink passage 503 includes a narrow portion and a wide portion, and the lengths of the narrow portion and the wide portion differ in accordance with the distance L. In the present embodiment, the width of the narrow portions is 33 μm, the size of the electrothermal transducers 500 is 36.2 μm×36.5 μm, and the diameter of the ink ejection orifices, which are circular, is 25 μm.

To make the ink ejection characteristics of the nozzles uniform, the lengths of the narrow portions and the wide portions of the ink passages in the nozzles are adjusted such that the flow resistance is uniform irrespective of the distance L. More specifically, the lengths of the narrow portions are reduced and the lengths of the wide portions are increased as the distance L increases. In the present embodiment, sixteen kinds of distances L are set. In one example, the minimum distance L is 86.5 μm, and the maximum distance L is 106.5 μm.

In the present embodiment, inkjet recording heads were manufactured in which the offsets between the centers of gravity of the ink ejection orifices 501 and the centers of gravity of the electrothermal transducers 500 were set to different values. More specifically, inkjet recording heads with four kinds of offsets, which are −4 μm, 0 μm, 4 μm, and 8 μm, were manufactured. The negative sign shows that the ink ejection orifices 501 are offset from the centers of gravity of the electrothermal transducers 500 in a direction away from the ink supply port 505, that is, in the downstream direction with respect to the flow of ink. In each of the four kinds of inkjet recording heads having various distances L as shown in FIG. 7, the offset between the centers of gravity of the ink ejection orifices and the centers of gravity of the electrothermal transducers is constant irrespective of the distance L. FIG. 7 shows the inkjet recording head in which the amount of offset is 4 μm. In the present embodiment, black ink, which contains carbon black pigment as the colorant, was used.

FIG. 8 shows the result of evaluation of the printing operation performed using the above-described inkjet recording heads. In FIG. 8, only the results of evaluation for the nozzle with the minimum distance L (86.5 μm) and the nozzle with the maximum distance L (106.5 μm) are shown. In the evaluation results, "GOOD" means that no print defects, such as deflection and ejection failure, have occurred. In addition, "FAIR" means that no ejection failure has occurred but some deflection has occurred, and "POOR" means that print defects such as deflection and ejection failure have occurred.

As is clear from FIG. 8, the minimum offset for preventing the print defects vary in accordance with the distance L. More specifically, the minimum offset is about 0 μm for the nozzle with the minimum distance L (86.5 μm), and is about +4 μm for the nozzle with the maximum distance L (106.5 μm).

Figure 9:
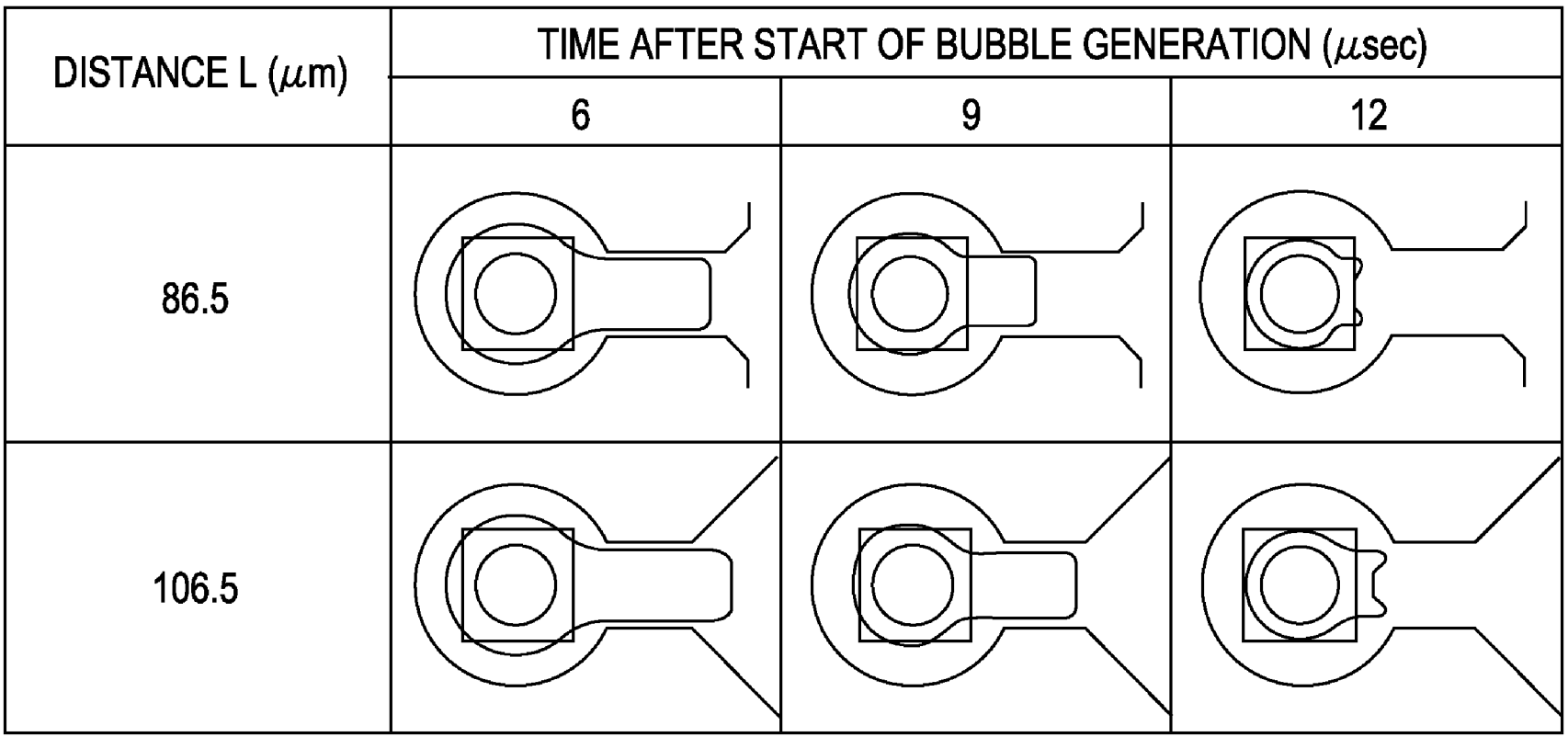
FIG. 9 is a schematic diagram illustrating the manner in which bubbles vanish according to the first embodiment of the present invention.

To find the reason for this, the manners in which the bubbles of ink appear and vanish in two nozzles having different distances L were observed. An inkjet recording head in which the offset between the centers of gravity of the ink ejection orifices and the centers of gravity of the electrothermal transducers was 0 μm was used for the observation. To enable a clear observation, ink which is free from carbon black pigment and in which the amount of solvent added thereto was adjusted such that the ink characteristics are the similar to those of the black ink was used. The result of the observation is shown in FIG. 9. The time at which the bubble generated in the nozzle with the minimum distance L (86.5 μm) vanishes differs from the time at which the bubble generated in the nozzle with the maximum distance L (106.5 μm) vanishes. This is because the lengths of the narrow portion and the wide portion of each ink passage are set to different values between the nozzle with the long distance L and the nozzle with the short distance L to make the flow resistance uniform. In the nozzle with the long distance L, the length of the narrow portion is relatively small. Therefore, the bubble generated in the ink in response to the operation of the electrothermal transducer extends into the area of the wide portion beyond the area of the narrow portion (see FIG. 9). In contrast, the bubble generated in the nozzle with the short distance L extends within the area of the narrow portion. Therefore, the time at which the bubble generated in the nozzle with the long distance L vanishes is later than the time at which the bubble generated in the nozzle with the short distance L vanishes.

Judging from the difference between the times at which the bubbles vanish and the result of evaluation of the printing operation, it can be assumed that the occurrence of print defects is affected by the manner in which the meniscus moves toward each electrothermal transducer in an area near the electrothermal transducer.

Figure 10A:
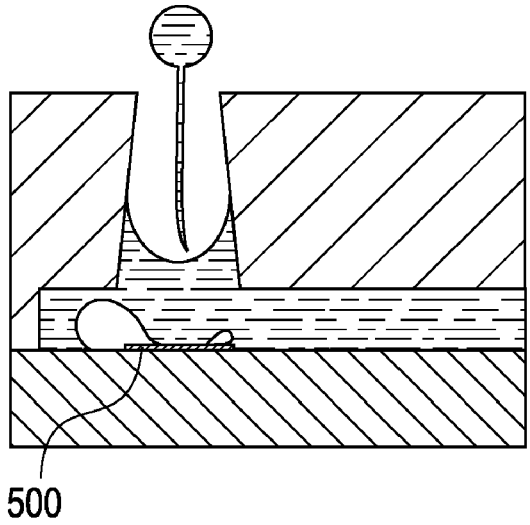
FIGS. 10A and 10B are schematic sectional views illustrating the manner in which bubbles vanish according to a comparative example.
Figure 10B:
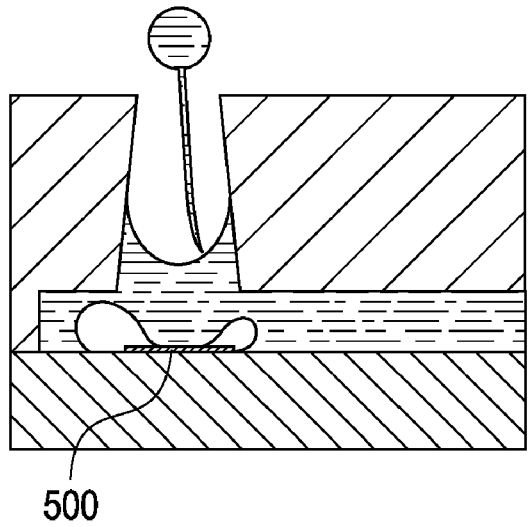

FIGS. 10A and 10B are schematic sectional views illustrating the mechanism of the above-described assumption. FIG. 10A shows a sectional view of the nozzle with the minimum distance L (86.5 μm) and FIG. 10B shows a sectional view of the nozzle with the maximum distance L (106.5 μm). In the nozzle with the minimum distance L (86.5 μm), the generated bubble vanishes within a relatively short time. Therefore, when the meniscus moves toward the electrothermal transducer 500 after the volume of the bubble reaches a maximum value, the area above the electrothermal transducer 500 is already refilled with the ink. Therefore, the possibility that the meniscus will directly hit the electrothermal transducer 500 is low. In contrast, in the nozzle with the maximum distance L (e.g., 106.5 μm), the time at which the generated bubble vanishes is later than that in the nozzle with the minimum distance L. Therefore, when the meniscus interface moves toward the electrothermal transducer 500, the area above the electrothermal transducer 500 is not sufficiently refilled with the ink. Therefore, the possibility that the meniscus interface will directly hit the electrothermal transducer 500 is relatively high. It can be assumed that the direction in which the ink is ejected is affected by the impact applied when the meniscus interface directly hits the electrothermal transducer 500.

Therefore, in the nozzles in which the distance L is long, the centers of gravity of the ejection orifices can be offset from the centers of gravity of the electrothermal transducers in the direction toward the ink supply port, as described above. In such a case, in the nozzles in which the distance L is long, the areas above the electrothermal transducers can be quickly refilled with ink so as to compensate for the delay in the time at which the bubbles vanish compared to that in the nozzles in which the distance L is short. Thus, the above-described time delay can be cancelled.

Thus, the reason why the occurrence of print defects varies in accordance with the offset between the centers of gravity of the ink ejection orifices and the centers of gravity of the electrothermal transducers can be assumed as follows. That is, the manner in which the meniscus interface moves in each nozzle varies in accordance with the offset, and whether or not the meniscus interface directly hits the electrothermal transducer is affected by the offset.

As shown in FIG. 8, when the offset between the centers of gravity of the ink ejection orifices and the centers of gravity of the electrothermal transducers is increased, the possibility that the print defects will occur decreases. However, if the offset is increased to a certain value or more, the ink ejection characteristics greatly vary and print defects due to causes other than the collection of ink will occur. It can be assumed that this is because the displacements between the ink ejection orifices and the electrothermal transducers are too large. In general, to use the energy generated by the electrothermal transducers for the ejection of ink with maximum efficiency, the ink ejection orifices can be positioned directly above the corresponding electrothermal transducers. If the displacements between the ink ejection orifices and the electrothermal transducers are too large, the energy from the electrothermal transducers cannot be efficiently used for the ejection of the ink. As a result, the ink ejection characteristics greatly vary. More specifically, a reduction in the ejection speed, for example, will probably occur.

Therefore, the time at which the bubbles vanish and the offset between the centers of gravity of the ink ejection orifices and the centers of gravity of the electrothermal transducers is set to adequate values. Thus, the print defects caused when the meniscus interfaces directly hit the electrothermal transducers and the print defects caused when the energy from the electrothermal transducers cannot be efficiently used for the ejection of ink can be reduced. The embodiment may provide an inkjet recording head capable of suppressing print defects caused by the collection of ink, such as deflection of ejected ink and ejection failure.

To provide sufficient allowances for the above-described two causes of the print defects, the offset between the centers of gravity of the ink ejection orifices and the centers of gravity of the electrothermal transducers can be varied in accordance with the distance L. More specifically, the offset can be increased as the distance L increases.

In addition, as described above, it can be assumed that the occurrence of print defects is affected by the time at which the bubbles vanish. Therefore, the offset between the centers of gravity of the ink ejection orifices and the centers of gravity of the electrothermal transducers can be varied in accordance with the time at which the bubbles vanish. More specifically, the offset can be increased as the time for the bubbles to vanish increases.

Thus, an inkjet recording head capable of increasing the quality of the recorded images can be provided by optimizing the offset in the above-described structure. The maximum value of the offset can be adequately adjusted in accordance with the properties of the ink that is used.

The above-described effects are not limited to the case in which the electrothermal transducers have a square shape, and similar effects can also be obtained when the electrothermal transducers have, for example, a rectangular shape or a trapezoidal shape.

In a second embodiment, the printing quality obtained by an inkjet recording head in which the offset between the centers of gravity of the ink ejection orifices and the centers of gravity of the electrothermal transducers varies in accordance with the distance L was observed. More specifically, an inkjet recording head in which the offset is increased as the distance L increases was used.

Figure 1:
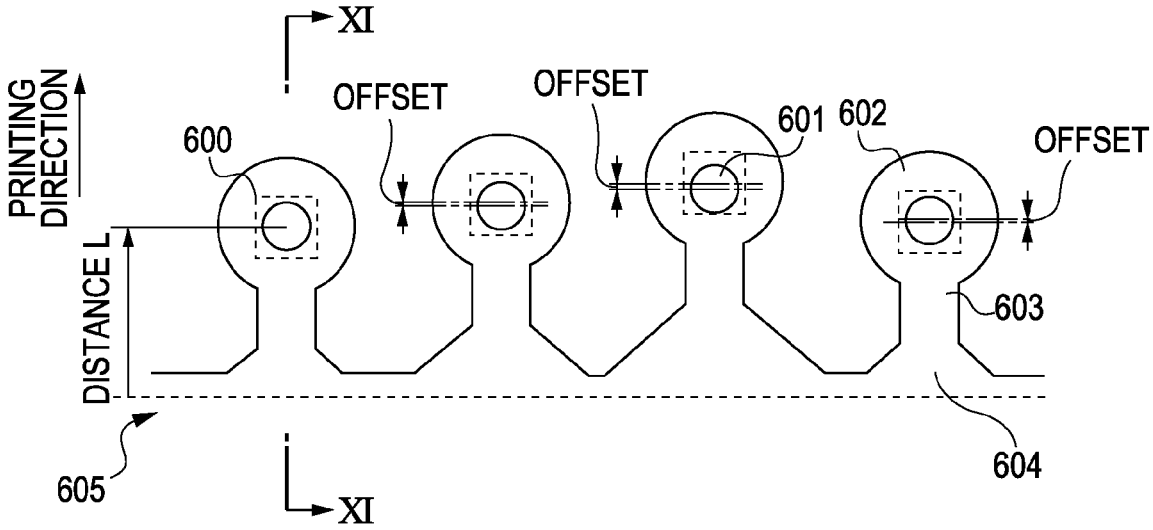
FIG. 1 is a schematic diagram illustrating a nozzle section of an inkjet recording head according to a second embodiment of the present invention.

FIG. 1 is a schematic diagram illustrating a nozzle section of an inkjet recording head according to the present embodiment. The inkjet recording head shown in FIG. 1 includes a common liquid chamber 604 which communicates with an ink supply port 605. Electrothermal transducers 600 which generate bubbles of ink to eject the ink and pressure chambers 602 in which the electrothermal transducers 600 are disposed are arranged on either side of the common liquid chamber 604.

Also in the present embodiment, similar to the first embodiment, the pressure chambers 602 and the electrothermal transducers 600 are positioned such that the center of gravity of each pressure chamber 602 coincides with the center of gravity of the corresponding electrothermal transducer 600. The ink passages 603 are disposed between the common liquid chamber 604 and the pressure chambers 602, and ink ejection orifices 601 are provided at positions where the ink ejection orifices 601 face the corresponding electrothermal transducers 600.

In this inkjet recording head, the positions of the ink ejection orifices 601 and the electrothermal transducers 600 which are next to each other are shifted from each other in a printing direction (direction in which the carriage is moved) by an amount of offset corresponding to a distance by which the carriage moves within a time interval between times at which respective driving blocks are driven. In other words, the distance L between the ink supply port and each electrothermal transducer differs between the nozzles which are next to each other. In the present embodiment, a plurality of kinds of distances L are set. More specifically, sixteen kinds of distances L are set. However, only four kinds of distances L are shown in FIG. 1 for simplicity. As described above, the positions of the ink ejection orifices and the electrothermal transducers in the printing direction are shifted by an amount of offset corresponding to the distance by which the carriage moves within the time interval between the times at which the respective driving blocks are driven. Accordingly, the ink droplets ejected from the ink ejection orifices land on the recording medium on a straight line. Each ink passage 603 includes a narrow portion and a wide portion, and the lengths of the narrow portion and the wide portion differ in accordance with the distance L.

In the present embodiment, the width of each narrow portion is 33 μm, the size of the electrothermal transducers 500, which has a square shape, is 34 μm×34 μm, and the diameter of the ink ejection orifices, which are circular, is 26 μm.

To make the ink ejection characteristics of the nozzles uniform, the lengths of the narrow portions and the wide portions of the ink passages in the nozzles are adjusted such that the flow resistance is uniform irrespective of the distance L. More specifically, the lengths of the narrow portions are reduced and the lengths of the wide portions are increased as the distance L increases. In the present embodiment, sixteen kinds of distances L are set. The minimum distance L is 86.5 μm, and the maximum distance L is 106.5 μm. Accordingly, the volumes of ink droplets ejected from the respective ejection orifices are substantially equal to each other.

The offset between the centers of gravity of the ink ejection orifices 601 and the centers of gravity of the electrothermal transducers 600 varies in accordance with the distance L. The nozzles corresponding to the sixteen kinds of distances L are divided into four groups. The four groups are defined as group A, group B, group C, and group D in order from the minimum distance L, each group corresponding to four kinds of distances L. The offsets in the nozzles which belong to group A, group B, group C, and group D are set to 0 μm, +1 μm, +2 μm, and +3 μm, respectively. The positive sign of the offsets shows that the ink ejection orifices 601 are offset from the centers of gravity of the electrothermal transducers 600 in a direction toward the ink supply port 605, that is, in the upstream direction with respect to the flow of ink. In the present embodiment, black ink, which contains carbon black pigment as the colorant, was used.

In a printing operation performed under the above-described conditions, the print defects caused when the meniscus interfaces directly hit the electrothermal transducers and the print defects caused when the energy from the electrothermal transducers cannot be efficiently used for the ejection of ink did not occur.

Figure 11A:
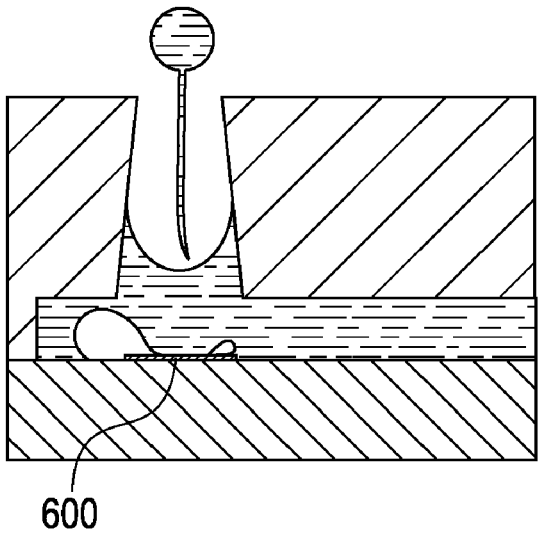
FIGS. 11A and 11B are schematic sectional views illustrating the manner in which bubbles vanish according to the second embodiment of the present invention.
Figure 11B:
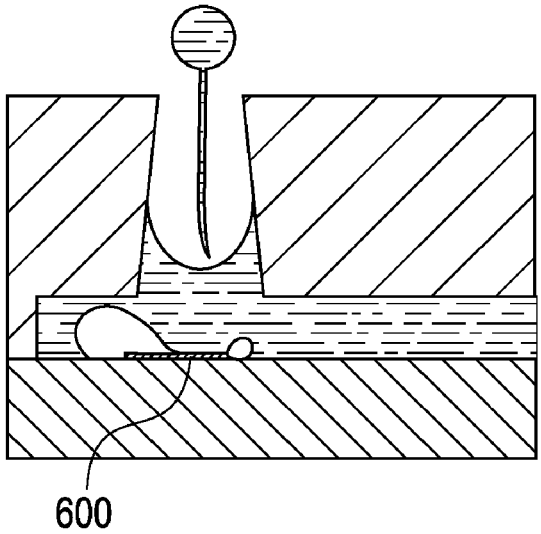

FIGS. 11A and 11B are schematic sectional views of the nozzles shown in FIG. 1 taken along line XI-XI. FIG. 11A is a sectional view of a nozzle which belongs to group A, and FIG. 11B is a sectional view of a nozzle which belongs to group D. In the nozzle which belongs to group A, the distance L is set to a minimum value and the bubble vanishes within a relatively short time. Therefore, when the meniscus interface moves toward the electrothermal transducer 600, the area above the electrothermal transducer 600 is already refilled with the ink. Therefore, the possibility that the meniscus interface will directly hit the electrothermal transducer 600 is low. In comparison, in the nozzle which belongs to group D, the distance L is set to a maximum value and it takes a relatively long time for the bubble to vanish. However, the offset between the center of gravity of the ink ejection orifice and the center of gravity of the electrothermal transducer 600 is set to a value different from that in group A, so that the meniscus interface is prevented from directly hitting the electrothermal transducer 600.

Thus, the offset between each ejection orifice and the corresponding electrothermal transducer is optimized in accordance with the distance L. Accordingly, even when the size of the electrothermal transducers is reduced to reduce energy consumption, an inkjet recording head capable of increasing the quality of the recorded images can be provided. According to the present embodiment, in at least one of the nozzles, the center of gravity of the ink ejection orifice is shifted from the center of gravity of the electrothermal transducer in a direction toward the ink supply port. In a nozzle with the shortest distance L, the center of gravity of the ink ejection orifice may coincide with the center of gravity of the electrothermal transducer.

The above-described effects are not limited to the case in which the electrothermal transducers have a square shape, and similar effects can also be obtained when the electrothermal transducers have, for example, a rectangular shape or a trapezoidal shape. The present invention is not limited to the embodiments and structures described in the specification, and various modifications are possible without departing from the sprit of the present invention.

As described in the above-described embodiments, the present invention relates to a recording method in which bubbles are generated in ink by the operation of the electrothermal transducers and the thus generated bubbles vanish without communicating with the external air.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-271040 filed Oct. 21, 2008, which is hereby incorporated by reference herein in its entirety.

What is claimed is:

1. An apparatus comprising:

a plurality of nozzles, each nozzle including a pressure chamber which houses an electrothermal transducer provided on a substrate to apply ejection energy to ink, an ink ejection orifice which faces the electrothermal transducer, and an ink passage along which the ink is supplied to the pressure chamber; and an ink supply port provided on the substrate, the ink supply port communicating with the ink passages, wherein a distance between a center of gravity of the electrothermal transducer and the ink supply port differs between the nozzles which are next to each other, and wherein, in at least one of the nozzles, a center of gravity of the ink ejection orifice is offset from the center of gravity of the electrothermal transducer in a direction toward the ink supply port by an amount, the amount being increased as the distance increased, and wherein the amount the distance increases is based on properties of ink being used.

2. The apparatus according to claim 1, wherein the center of gravity of the pressure chamber coincides with the center of gravity of the electrothermal transducer.

3. The apparatus according to claim 1, wherein volumes of ink droplets ejected from the ink ejection orifices in the nozzles which are next to each other are equal to each other.

4. The apparatus to claim 1, wherein the nozzles include a nozzle in which the center of gravity of the ink ejection orifice coincides with the center of gravity of the electrothermal transducer.

5. The apparatus according to claim 4, wherein the distance is smallest in the nozzle in which the center of gravity of the ink ejection orifice coincides with the center of gravity of the electrothermal transducer.

6. The apparatus according to claim 4, wherein a time for a bubble generated in the ink by the electrothermal transducer to vanish is shortest in the nozzle in which the center of gravity of the ink ejection orifice coincides with the center of gravity of the electrothermal transducer.

7. The apparatus according to claim 1, wherein each ink passage has a narrow portion and a wide portion, and lengths of the narrow portions are reduced and lengths of the wide portions are increased as the distance increases.

8. The apparatus according to claim 1, wherein the apparatus comprises an inkjet recording head.

9. A method for performing a recording operation by ejecting ink from the apparatus according to claim 1, the method comprising:

causing a bubble generated in the ink by the electrothermal transducer to vanish without communicating with the external air.

* * * * *